United States Patent [19]

Comeyne

[11] 4,434,560

[45] Mar. 6, 1984

[54] AIMING AID FOR AN AIMING DEVICE IN A LOW LIGHT LEVEL ENVIRONMENT

[75] Inventor: Robert G. Comeyne, Stafford, Va.

[73] Assignee: The United States of America as represented by the Secretary of the Army, Washington, D.C.

[21] Appl. No.: 469,671

[22] Filed: Feb. 25, 1983

[51] Int. Cl.[3] ..... F41G 1/32; F41G 11/00

[52] U.S. Cl. ..... 33/241; 42/1 S

[58] Field of Search ..... 33/241, 242, 243, 233; 42/1 S

[56] References Cited

U.S. PATENT DOCUMENTS

| | | | |
|---|---|---|---|
| 3,678,590 | 7/1972 | Hayward | 33/241 |
| 3,698,092 | 10/1972 | Rosenhan | 33/241 |
| 3,914,873 | 10/1975 | Elliott et al. | 33/241 |

*Primary Examiner*—Harry N. Haroian

*Attorney, Agent, or Firm*—Robert P. Gibson; Milton W. Lee; Max L. Harwell

[57] ABSTRACT

An aiming aid that shows the orientation of an aiming device, such as hand held weapons, in a dark environment without being observed by someone at the forward end of the device. The aiming aid is comprised of a very small light source embedded in a milled out hollow section of the weapon barrel which transmits light through the hollow section and a cavity in a front sight to be emitted through a front sight fiber optics pattern only back toward a rear sight. Light from the light source is also transmitted through a rear sight fiber optics pattern, after possibly being transmitted through a light scattering rod positioned on top of the weapon, and is emitted only backward. A shooter aligns the rear and front light patterns to provide the proper aiming of the device.

9 Claims, 5 Drawing Figures

AIMING AID FOR AN AIMING DEVICE IN A LOW LIGHT LEVEL ENVIRONMENT

The invention described herein may be manufactured, used and licensed by the U.S. Government for governmental purposes without the payment of any royalties thereon.

BACKGROUND OF THE INVENTION

1. Field of the Invention

The invention is in the field of aiming devices, such as a hand held weapon, sight orientation in the dark with a light source which only emits in the rearward direction.

2. Description of the Prior Art

Aiming lights have previously been placed on hand held weapons to boresight the weapon. The light sources used in the aiming lights may be of the visible type if detection is no problem, or of the infrared type if it is desired that the light not be detected by the unaided human eye. The infrared light may be detected by the use of appropriate infrared viewers. A disadvantage of using infrared light source is that someone else may use infrared viewers and detect the infrared light, and thus the location of the weapon.

Laser aiming lights have previously been used in boresighting hand held weapons. These lights, whether visible or infrared, may be detected. Further, in a total dark condition the laser does not aid in the alignment of the front and rear sights of the weapon. Foggy or hazy conditions tend to scatter or defract the laser beam thus making the beam ineffective.

Phosphor dots are also used under no light conditions but the main disadvantage of this is in the amount of time the phosphor will give off light before having to be exposed to an energy source to recharge the phosphors. The present fiber optic aiming aid is fully illuminated upon demand by applying power to a light source.

SUMMARY OF THE INVENTION

The present invention is an aiming aid for use in a low light, or dark, environment for visual orientation of an aiming device, herein referred to as a weapon but is not intended to be limited thereto. The aiming aid is comprised of modifications made to weapons which when completed enable the weapon shooter to recognize the orientation of the weapon in the darkened environment. The aiming aid is comprised of a very small light source, positioned in a hollow section removed from the weapon barrel, with the light source providing light to a plurality of fiber optics in a front sight and through a light scattering rod to a plurality of fiber optics in a rear sight. The light scattering rod is preferably placed on the top of the weapon, but is actually optional since it might emit enough light for the enemy to also see. Front and rear sight light patterns, which are selectively formed by the placement of the output ends of the fiber optics, may be viewed by the shooter with respect to each other to indicate the proper aiming direction of the weapon. Since all the light from both the front sight and rear sight patterns are directed to the rear of the weapon anyone forward of the weapon will not be able to observe the light and thus disclose the shooters location.

The invention will be better understood by reference to the following description taken in conjunction with the following drawings.

DETAILED DESCRIPTION OF THE PREFERRED EMBODIMENT

Figure 1:
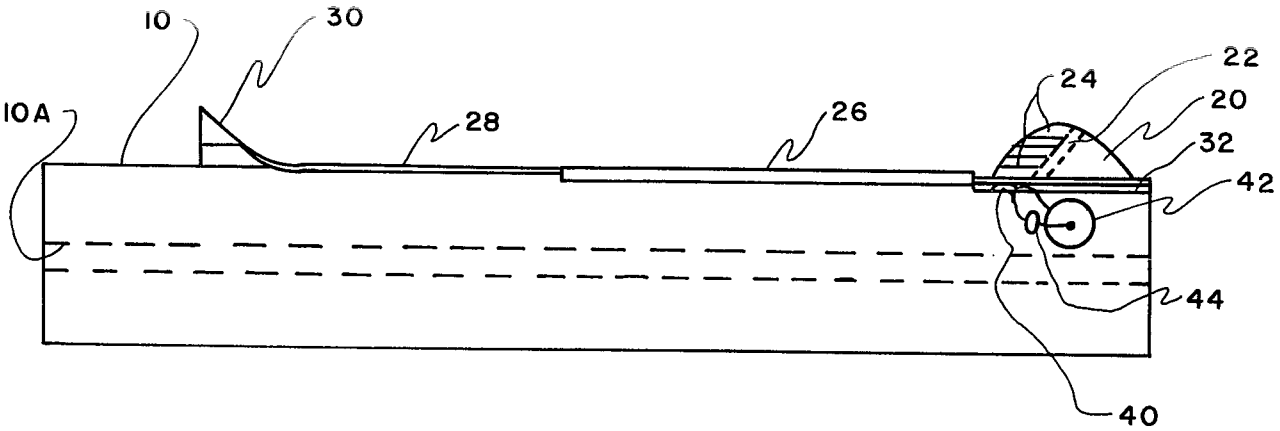
FIG. 1 is a partial sectional elevational view of the weapon barrel illustrating one arrangement of the present weapon aiming aid.
Figure 2:
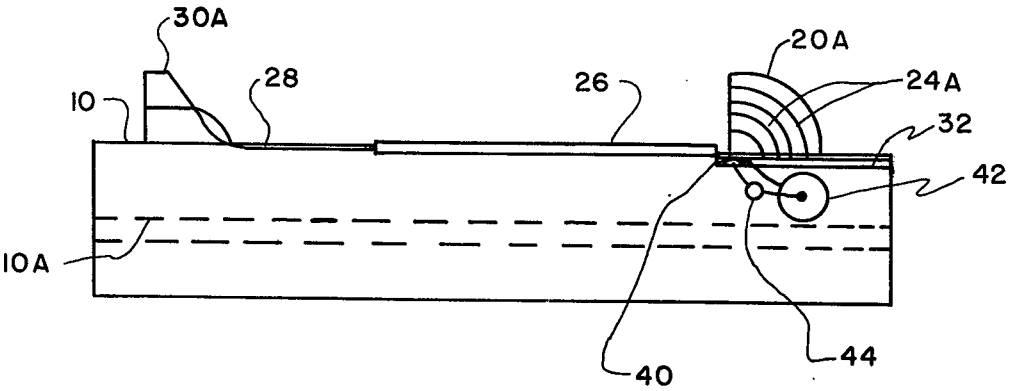
FIG. 2 illustrates schematically another concept of both front and rear sights.

Refer now to the details of FIG. 1 where only the barrel of a weapon is shown, representative of the aiming device, with the present aiming aid attached thereto. Modifications are made to the weapon barrel as follows. A section of the front sight 20 is removed to place fiber optics 24 therein while leaving a cavity 22 behind the fiber optics. A portion of the barrel is removed, preferably by milling, to provide a hollow section 32 into which a light source 40 is placed. Adjacent to the hollow section 32 a deep groove is formed on top of the barrel along the longitudinal axis thereof back toward the rear sight 30. A light scattering rod 26, preferably made of PLEXIGLASS of about 1/32 inch diameter, is then inserted in the deep groove and may be held by some holding means, such a friction fit or other appropriate retaining means. It should be noted that PLEXIGLASS is not glass but is a clear acrylic plastic.

Source 40 may be a wheat grain lamp but is preferably a light-emitting diode (LED) which can better withstand shock. The forward end of section 32 is then sealed by a convenient sealing means, such as black epoxy, to keep light from source 40 from being emitted from the front of the weapon barrel and thus disclose the shooters position. The front sight is also modified to place the multiple of front sight fiber optics 24 in a select pattern. The modification of front sight 20 may be as follows. A beveled cut may be made in the very center of the rear half of front sight 20 up to a little over half of the sight 20. The fiber optics 24 are placed in the open space left by the cut in a pattern, called a front sight light pattern, while leaving a cavity 22 behind the fiber optics where light from the light source 40 can enter through the hollow section and the cavity and be emitted out the fiber optics 24 back toward the rear sight. Alternately, front sight 20 may be cut entirely through in the very center thereof and the front portion filled in with a black epoxy with the fiber optics 24 also embedded in the black epoxy while leaving the cavity 22 for light transmission.

Simultaneously, the light from source 40 is refracted by the light scattering rod 26 to give the weapon user an easy visible indication of the orientation of the top of the weapon, especially while the weapon is in the raised position where any enemy in the forward area cannot see the light refracted from rod 26. The rear fiber optics 28 receive the light from rod 26 and transmits the light therethrough to be emitted out the rear sight 30 in a rear sight light pattern. The minimum number of fiber optics in the front and rear sight light patterns for optimum use are preferably 2 and 4. However more fibers may be used depending on the shooters preference. It should be noted that the light scattering rod 26 may be eliminated and the rear fiber optics 28 extended adjacent to the light source wherein the light enters the rear fiber optics directly.

The fiber optics 24 and 28 are preferably about 10 to 30 microns in diameter. The light scattering rod 26 is preferably less than 1/16 of an inch in diameter and when embedded in the top of the weapon barrel only has a very small portion exposed. These modifications of the weapon barrel and additions thereto have no adverse effects in high light conditions due to the very small sizes of the fiber optics and the light scattering rods themselves. The smallness of the fiber optics also makes them extremely flexible which facilitates lacing of the fibers. Unlike the laser aiming light, the present weapon aiming aid does not give away the shooters location since all of the light being emitted is in the direction of the rear of the weapon so that someone in the forward area cannot see the light. It should be noted that the transmittance of white light by a fiber optic 10 inches long is between 45% and 60%. This makes the fiber optics a very good transferer of light. The fiber optics used in any anticipated hand held weapon would be less than 10 inches.

The electrical attachments to the light source 40 may be as follows. A small battery 42, perhaps a mercury watch type battery, may be attached to the forward end of the weapon barrel in a milled out hole. A set of contacts may be installed on battery 42 and very small electrical leads attached thereto. The electrical leads are then connected to the light source 40 with a switch 44 inserted in one of the leads. The switch 44 may be of a slide or push button type. Particularly good locations for the switch may however be somewhere around the stock or trigger housing area, or be a part of the safety release of a U.S. Army 45 caliber type weapon.

Look now a little closer to FIG. 1 which shows a typical halfmoon front sight 20 and rear sight 30 for a U.S. Army 45 caliber hand held weapon which is modified to include the aiming aid. The front sight 20 is milled out in the very center thereof and a multiple of front sight fiber optics 24 is placed in the above mentioned front sight pattern. The fiber optics are preferably sealed in by black epoxy including leaving cavity 22 only at the top of sight 20 open into the hollow section 32, wherein light from source 40 is readily transmitted through section 32 and cavity 22 and is emitted out the output ends of optics 24 toward the rear sight 30, i.e. toward the back of the weapon. Meanwhile the light is transmitted by the rear fiber optics 28 out of the back of the weapon. Optics 28 are terminated in the groove of the rear sight 30 in the rear fiber optics pattern. The weapon is originally boresighted by aligning the front and rear fiber optic patterns.

Figure 4:
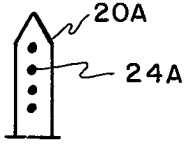
FIG. 4 illustrates schematically the front sight with one fiber optic arrangement.
Figure 5:
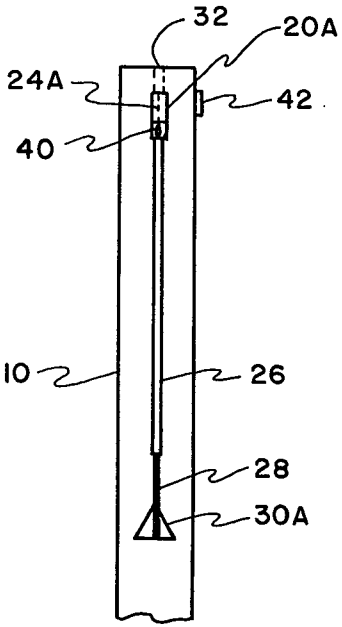
FIG. 5 illustrates a top view of the weapon barrel with the aiming aid.
Figure 3:
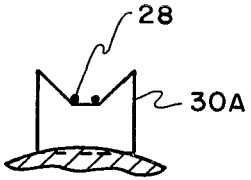
FIG. 3 illustrates schematically the rear sight with one fiber optic arrangement.

Look now at FIGS. 2, 3, 4, and 5 for an explanation of another embodiment of the front and rear sights which are very similar to that shown in FIG. 1 and carries like reference numerals for like elements. The front sight 20A is this time a quarter circle with the multiple of fiber optics 24A sweeping in quarter circles from the hollow section 32 to the output thereof which is positioned to emit light directly toward the rear sight 30A. Rear sight 30A is shown in FIG. 3 as having a flat grooved out portion within which the rear fiber optics 28 terminate in a rear sight pattern, which in this teaching is two fiber optics on opposite sides of the groove in a horizontal row. Other patterns for the rear sight and the vertical row of fiber optic outputs as shown in FIG. 4 but this number of fiber optics in the sight is not considered a limit. The illustration of FIG. 5 is used to show the top view of the weapon barrel 10 with the aiming aid positioned thereon. It should be noted again that the refractive light scattering rod 26 may be eliminated entirely for even more secure operation of the weapon, and the rear fiber optics 28 run along the weapon to the rear sight.

The foregoing is considered as illustrative only of the principles of the invention. Since further modifications and changes will readily occur to those skilled in the art, the invention is not intended to be limited to the exact construction and operation shown and described and accordingly all suitable modifications may be resorted to falling within the scope of the invention as claimed.

I claim:

1. An aiming aid for visual orientation of an aiming device in a very low light level environment without emitting light in the forward direction to disclose the location of said aiming device, said aiming aid comprising:

a switchably energized light source comprised of a light emitting diode enclosed inside a hollow section of an aiming device housing;

a front sight fiber optic means having a cavity in an input end with said cavity in cooperation with said hollow section to accept transmitted light from said light source and an output that emits light in a select front sight light pattern in the rearward direction of said aiming device; and a rear sight fiber optic means having an input end in cooperation with said light source for receiving light therein through a light scattering rod partially embedded in the top of said aiming device to provide a visual orientation of said aiming device and transmitting the light to an output for emitting light in a select rear sight light pattern in a rearward direction wherein alignment of said select front and rear sight light patterns of emitted light establish a front to rear sight alignment of said aiming device.

2. An aiming aid as set forth in claim 1 wherein said light scattering rod is made of PLEXIGLASS which is less than 1/16 inch in diameter.

3. An aiming aid as set forth in claim 1 wherein said switchably energized light source is switched by a slide type switch connected between said light emitting diode and a watch type battery wherein said slide type switch and said battery are attached to the exterior of said aiming device.

4. An improved aiming aid for a hand held weapon under a very low light level environment without disclosing the location of said weapon to a threatening adversary, the improvement comprising:

a light source enclosed in an interior hollow section of the weapon barrel;

a switchable energizing means mounted on the exterior of said weapon barrel for selectively energizing said light source;

a modified front sight having a front sight light pattern of fiber optics therein in communication through a cavity in said front sight and said hollow section to light transmitted from said light source to emit light in the rearward direction along the top said weapon in said front sight light pattern;

a light scattering rod partially embedded in the top of said weapon barrel with an input end adjacent to said light source; and a rear sight having a rear sight light pattern of fiber optics having an input end adjacent an output end of said light scattering rod and an output end secured within the groove of said rear sight wherein light from said light source is simultaneously refracted and transmitted through said light scattering rod to said input end of said fiber optics adjacent said light scattering rod and is emitted out said output end in a rearward direction to establish a front to rear sight alignment of said weapon wherein light refracted from said light scattering rod provides a visual orientation of the top said weapon.

5. An improved aiming aid as set forth in claim 4 wherein said front sight light pattern of fiber optics is comprised of at least four strands of fiber optics mounted in a vertical row.

6. An improved aiming aid as set forth in claim 5 wherein said rear sight light pattern of fiber optics is comprised of at least two strands of fiber optics mounted in a horizontal rows.

7. An improved aiming aid as set forth in claim 6 wherein each strands of fiber optics is 10 to 30 microns in diameter.

8. An improved aiming aid as set forth in claim 4 wherein said modified front sight is halfmoon shaped with said cavity and fiber optics in the rearmost portion of said front sight.

9. An improved aiming aid as set forth in claim 4 wherein said modified front sight is a quarter circle with the input ends of said fiber optics in direct communication with said interior hollow section with each strand of said fiber optics sweeping through a quarter circle radius of curvature to the output ends thereof which are positioned to emit light rearward over said weapon barrel.

* * * * *